US007775364B1

(12) United States Patent
Archambault et al.

(10) Patent No.: US 7,775,364 B1
(45) Date of Patent: Aug. 17, 2010

(54) GRASPING CLOSURE SYSTEM FOR CONTAINER FOR FRANGIBLE ITEMS

(75) Inventors: Germain Archambault, Saint-Hubert (CA); François Blanchette, Mirabel (CA)

(73) Assignee: Interplast Packaging Inc., Terrebonne (CA)

( * ) Notice: Subject to any disclaimer, the term of this patent is extended or adjusted under 35 U.S.C. 154(b) by 0 days.

(21) Appl. No.: 12/628,242

(22) Filed: Dec. 1, 2009

(51) Int. Cl.
*B65D 85/32* (2006.01)

(52) U.S. Cl. ..... 206/521.1

(58) Field of Classification Search ..... 206/521, 206/521.1, 521.15, 521.2, 521.3, 521.4, 521.5, 206/521.6, 521.7, 521.8; 220/508
See application file for complete search history.

(56) References Cited

U.S. PATENT DOCUMENTS 3,570,747 A * 3/1971 McKenna et al. ..... 206/521.1
4,240,575 A * 12/1980 Tange ..... 206/521.1
4,625,906 A * 12/1986 Mangla ..... 206/521.1
7,255,231 B2 * 8/2007 Andrews et al. ..... 206/521.1

* cited by examiner

*Primary Examiner*—Jacob K Ackun, Jr.
(74) *Attorney, Agent, or Firm*—Ogilvy Renault LLP

(57) ABSTRACT

A container comprises a sheet of polymer formed into a base portion. The base portion has cavities for receiving and supporting frangible items. A cover portion has cavities for covering the frangible items. The cover portion has a flat peripheral wall defining concavities. A first hinge rotates the cover portion onto the base portion to hold the items captive. An elongated tab has male connectors oriented with a ramp portion. A female connector projects from the peripheral wall of the cover portion and is in vertical alignment with the male connectors. A second hinge rotates the tab toward the interior of the base portion. Connectors block the cover portion to the base portion when closed together. A grasping wall spans between and projects from the receiving cavities and from the container, defining a grasping surface. A clearance is positioned between the female connector and the base portion when the container is closed.

16 Claims, 5 Drawing Sheets

GRASPING CLOSURE SYSTEM FOR CONTAINER FOR FRANGIBLE ITEMS

FIELD OF THE APPLICATION

The present application relates to containers for receiving frangible objects such as eggs, and to structural components of such containers.

BACKGROUND OF THE ART

Egg containers of all kinds have been developed for the transportation and sale of eggs. As eggs are relatively fragile, the egg containers must protect the eggs from the various manipulations involved from the packaging of the eggs to the consumer's refrigerator.

One significant improvement in egg containers is the use of thermoformed plastics as material for the egg containers. Thermoformed plastics are typically transparent, which allows the eggs to be visible, and are relatively inexpensive to produce. As they can inspect the eggs by seeing through the material of the egg container, the consumers do not need to open the egg container, as is the case with cardboard egg containers, for instance. In the case of cardboard boxes, it may occur that the boxes are not closed properly after inspection. This may cause the breakage of eggs if the improperly closed egg container is subsequently manipulated by another consumer.

SUMMARY OF THE APPLICATION

It is therefore an aim of the present disclosure to provide a novel egg container.

Therefore, in accordance with the present application, there is provided a container for receiving frangible items comprising a sheet of polymer formed into: a base portion having a plurality of item receiving cavities for supporting frangible items; at least one cover portion having at least one item covering concavity for covering the frangible items, the cover portion having a generally flat peripheral wall defining the at least one item covering concavity; a first hinge between a first longitudinal edge of the base portion and the cover portion for rotating the cover portion onto the base portion to hold the frangible items captive in the item receiving cavities; connectors to block the cover portion to the base portion when closed together; at least one grasping wall spanning between the two item receiving cavities on an opening side of the container, the two item receiving cavities being along a second longitudinal edge of the base portion, the grasping wall projecting away from the two egg receiving cavities and outward from the container to define a grasping surface; and friction surface means on the grasping surface.

Further in accordance with the present application, there is provided a container for receiving frangible items comprising a sheet of polymer molded into: a base portion having a plurality of item receiving cavities for supporting frangible items; a cover portion having at least one item covering concavity for covering the frangible items, the cover portion having a generally flat peripheral wall defining the at least one item covering concavity; a first hinge between a first longitudinal edge of the base portion and the cover portion for rotating the cover portion onto the base portion in closing the container to hold the frangible items captive in the item receiving cavities; an elongated tab having wedge-shaped male connectors oriented with a ramp portion facing upward; a second hinge between a second longitudinal edge of the base portion and the elongated tab for rotating the elongated tab toward an interior of the base portion; at least one female connector projecting outwardly from the generally flat peripheral wall of the cover portion, the at least one female connector being in vertical alignment with the wedge-shaped male connectors of the tab for mating engagement therewith when the container is closed; and at least one outwardly projecting clearance positioned between the at least one wedge-shaped female connector and the second longitudinal edge of the base portion when the container is closed.

DESCRIPTION OF THE PREFERRED EMBODIMENTS

Figure 1:
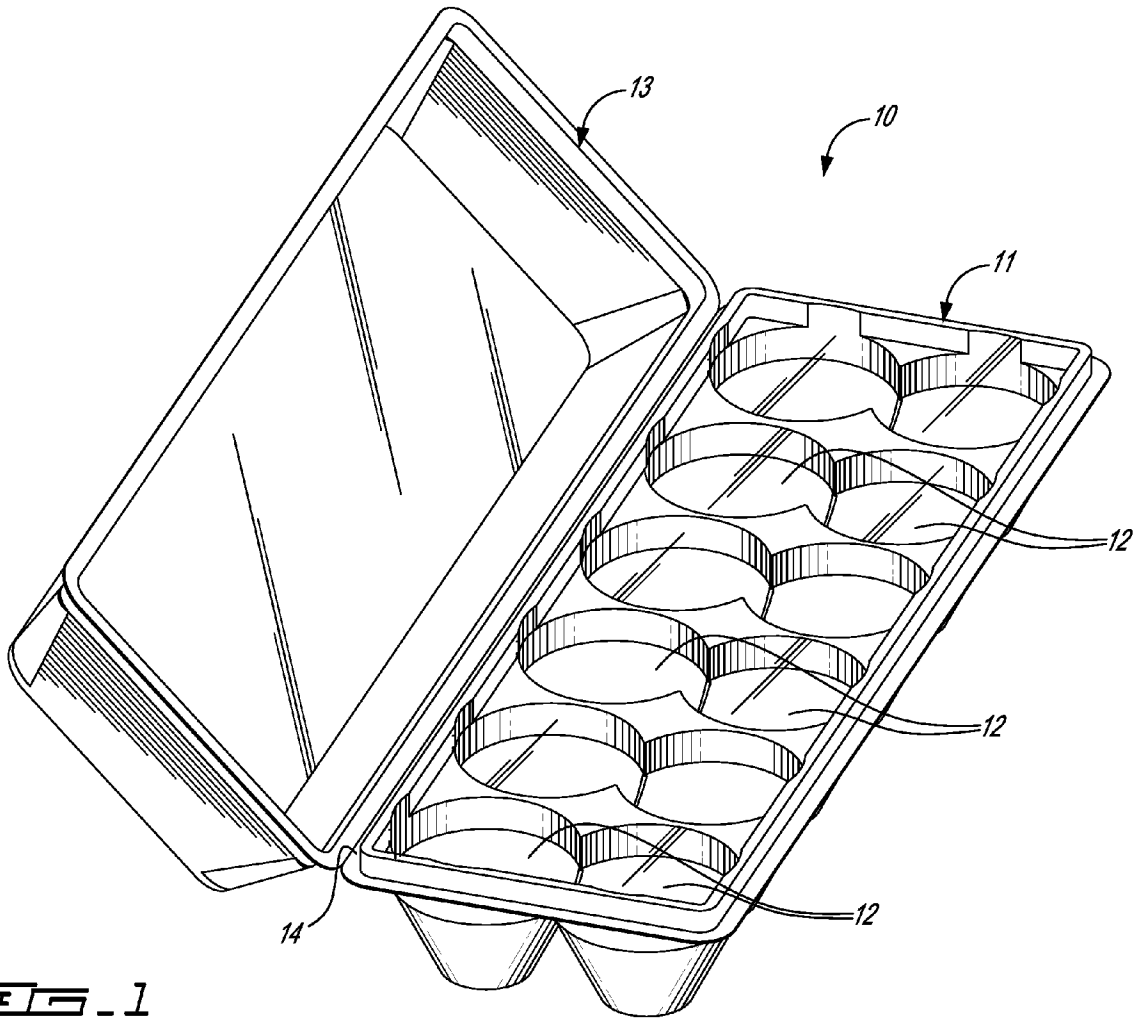
FIG. 1 is a schematic perspective view of a two-fold egg container.

Referring to the drawings and more particularly to FIG. 1, an egg container is generally shown at 10. The egg containers described hereinafter are preferably made of transparent or translucent plastics, for instance using a thermoforming process or other molding process. Other materials and/or processes may be used as well. The containers described hereinafter may be used to contain eggs or any other frangible items (e.g., tomatoes).

The egg container 10 of FIG. 1 is a two-fold egg container, as it has two portions hinged to one another. The egg container 10 has a base portion 11 having a plurality of egg-receiving cavities 12 (e.g., six, twelve, eighteen, twenty-four, or any other suitable number), with each cavity 12 supporting an egg. A top cover portion 13 is hinged to the base portion 11 by hinge 14. The top cover portion 13 may or may not have egg cavities to cover a top portion of the eggs supported by the egg-receiving cavities 12. Alternatively, the top cover portion 13 may present a flat top surface as in FIG. 1, with or without strengthening components (e.g., arches, posts). Although not shown, mating connectors or any other suitable type of connectors are provided on the periphery of the base portion 11 and top cover portion 13 for interlocking them when the egg container 10 is closed.

Figure 2:
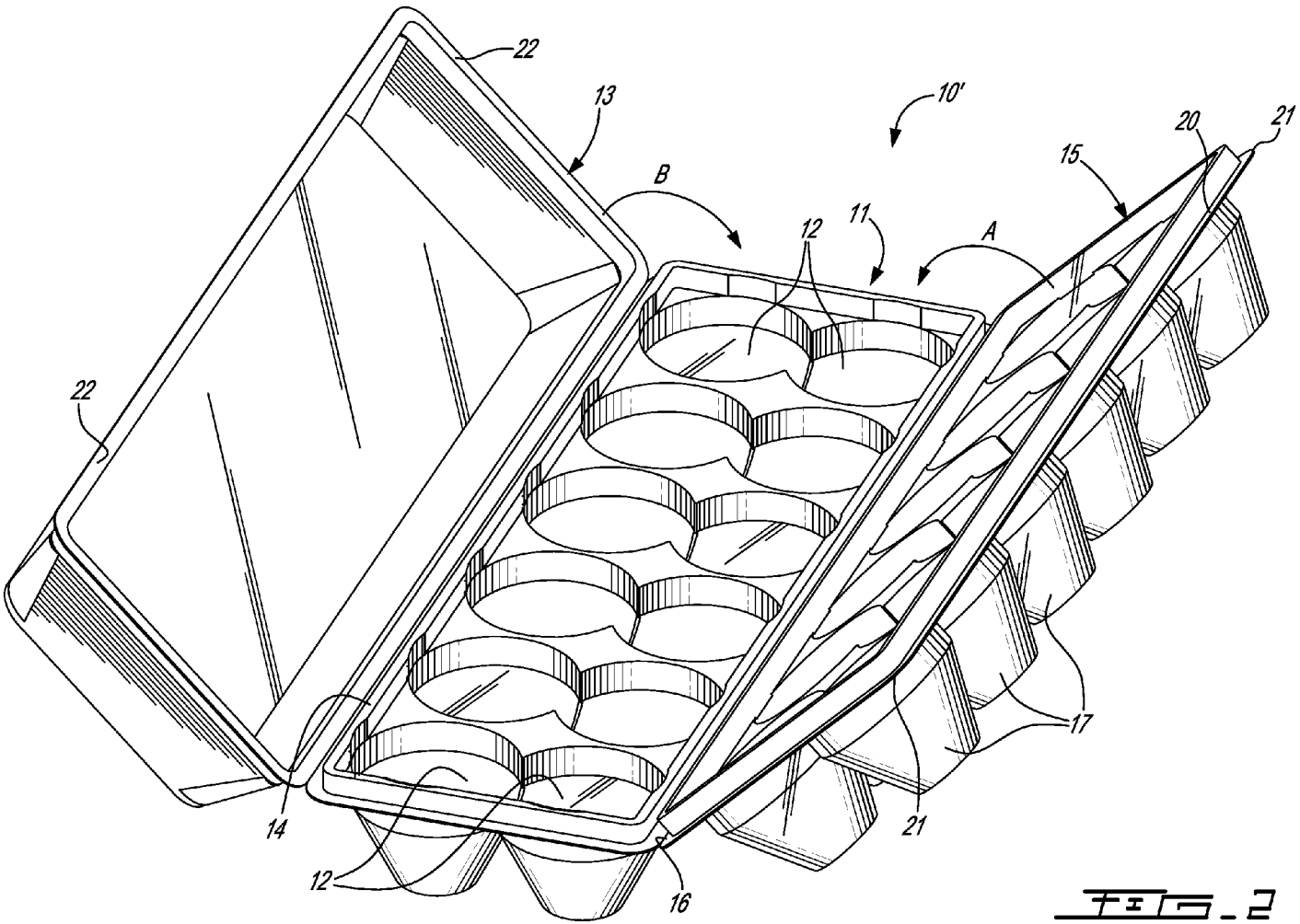
FIG. 2 is a schematic perspective view of a three-fold egg container.

Referring to FIG. 2, a three-fold egg container is generally illustrated at 10'. The egg container 10' is similar to the egg container 10 of FIG. 1, but has a middle cover portion 15. The middle cover portion 15 is hinged to the base portion 11 by hinge 16. The hinges 14 and 16 are preferably on opposite edges of the base portion 11. The middle cover portion 15 typically has egg cavities 17 to cover a top portion of the eggs supported by the egg-receiving cavities 12. Although not shown, mating connectors or any other suitable type of connectors are provided on the periphery of the top cover portion 13 and the middle cover portion 15 for interlocking them when the egg container 10' is closed.

In order to close the egg container 10', the middle cover portion 15 is firstly hinged into contact with the base container 12, as illustrated by arrow A. The top cover portion 13 is then hinged onto the middle cover portion 15, as illustrated by arrow B. When the egg container 10/10' is closed, peripheral flanges 21 and 22 lay flat one on the other.

Figure 3:
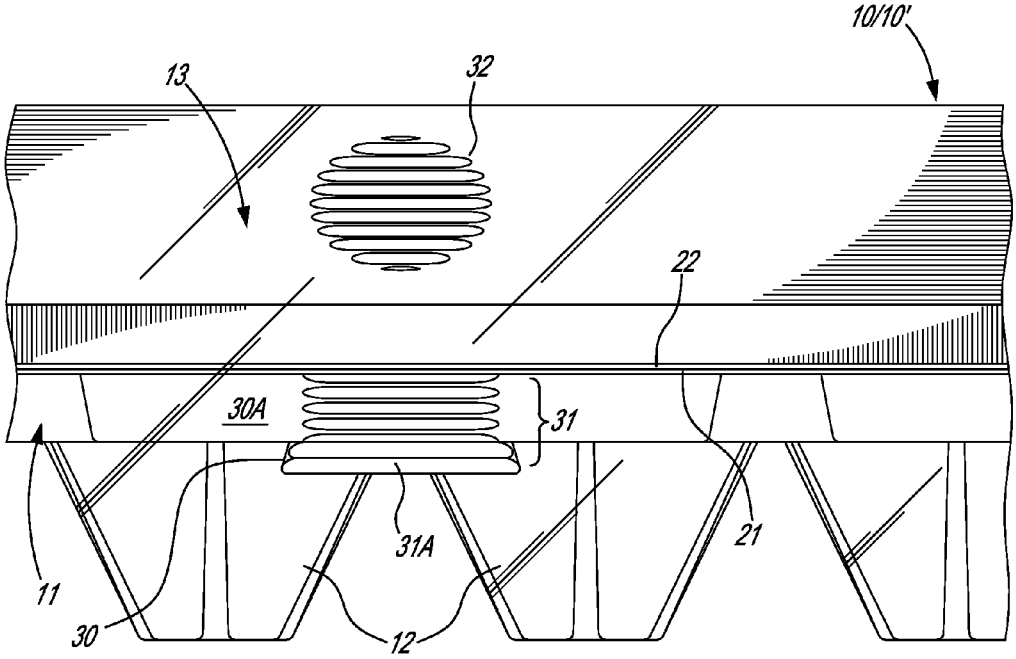
FIG. 3 is an enlarged elevation view of a grasping system for the egg containers of FIGS. 1 and 2.

Referring to FIG. 3, the egg container 10/10' is shown having a grasping system for facilitating the opening of the egg container 10/10' (i.e., two-fold or tri-fold egg container). The grasping system is positioned on an opening side of the egg container 10/10' and comprises a wall 30 that projects forwardly in the base portion 11, and toward an exterior of the base portion 11. The wall 30 spans between top parts of two of the egg receiving cavities 12, preferably between the egg receiving cavities 12 that are on opposite sides of a central axis of the egg container 10/10'. The wall 30 projects forwardly from the egg receiving cavities 12. It is observed in FIG. 5 that there is a single wall 30 in the egg container 10/10', but there may be more on the opening side of the egg container 10/10'. However, there are preferably pairs of egg receiving cavities 12 with no wall 30 between them. Accordingly, the absence of other such walls visually emphasizes the presence of this component of the grasping system on the base portion 11. The wall 30 merges into a vertical portion 30A of the peripheral wall of the base portion 11.

Protrusions such as ribs 31 are provided on the wall and project forwardly therefrom. The ribs 31 form a friction surface that will be contacted by a finger/fingers of a user when opening the egg container. The ribs 31 are illustrated as being partly on the wall 30, and partly on the vertical portion 30A of the peripheral wall of the base portion 11. The ribs 31 are generally horizontal, and are therefore transverse to an opening direction of the egg container 10/10'. An oversized rib 31A may be provided at a bottom of the wall 30, for reinforcing the wall 30. Other geometries may be used for the friction surface as an alternative to ribs. For instance, a plurality of pimples may be provided. Alternatively, gripping patches may be glued to the wall 30. Any suitable friction surface means may be used.

Figure 5:
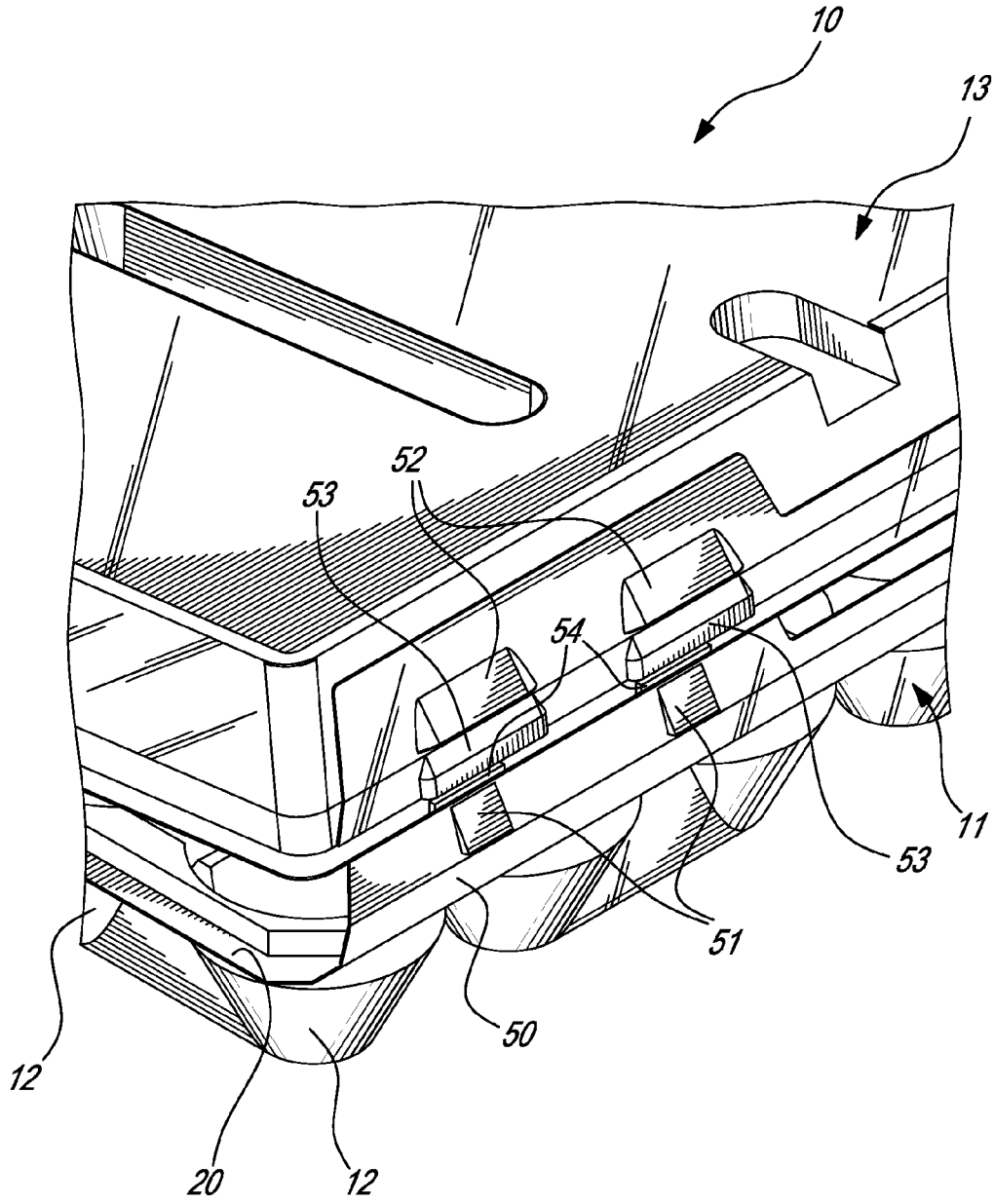
FIG. 5 is an enlarged perspective view of a closure system of the egg container of FIG. 4.

Still referring to FIG. 5, another set of protrusions are provided on the top cover portion 13, and is illustrated as ribs 32. The ribs 32 are parallel to the ribs 31, and generally define a circular shape to match that of a finger tip. The ribs 32 may define other shapes as well. Other geometries may be used for the protrusions as an alternative to ribs. For instance, a plurality of pimples may be provided.

The presence of protrusions on both the base portion 11 and the top cover portion 13 guide a user in opening the egg container 10/10' with the grasping system. As the grasping system may be centrally located on the egg container 10/10', the opening pressure is generally evenly distributed on the top cover portion 13, thereby facilitating the separation of the top cover portion 13 from the base portion 11.

As the vertical portion 30A is longer than the wall 30, it has a tendency to deform prior to the wall 30, when pressure is applied to the ribs 31. Accordingly, the egg receiving cavities 12 are protected from deformation by the presence of some of the ribs 31 in the vertical portion 30A.

Figure 4:
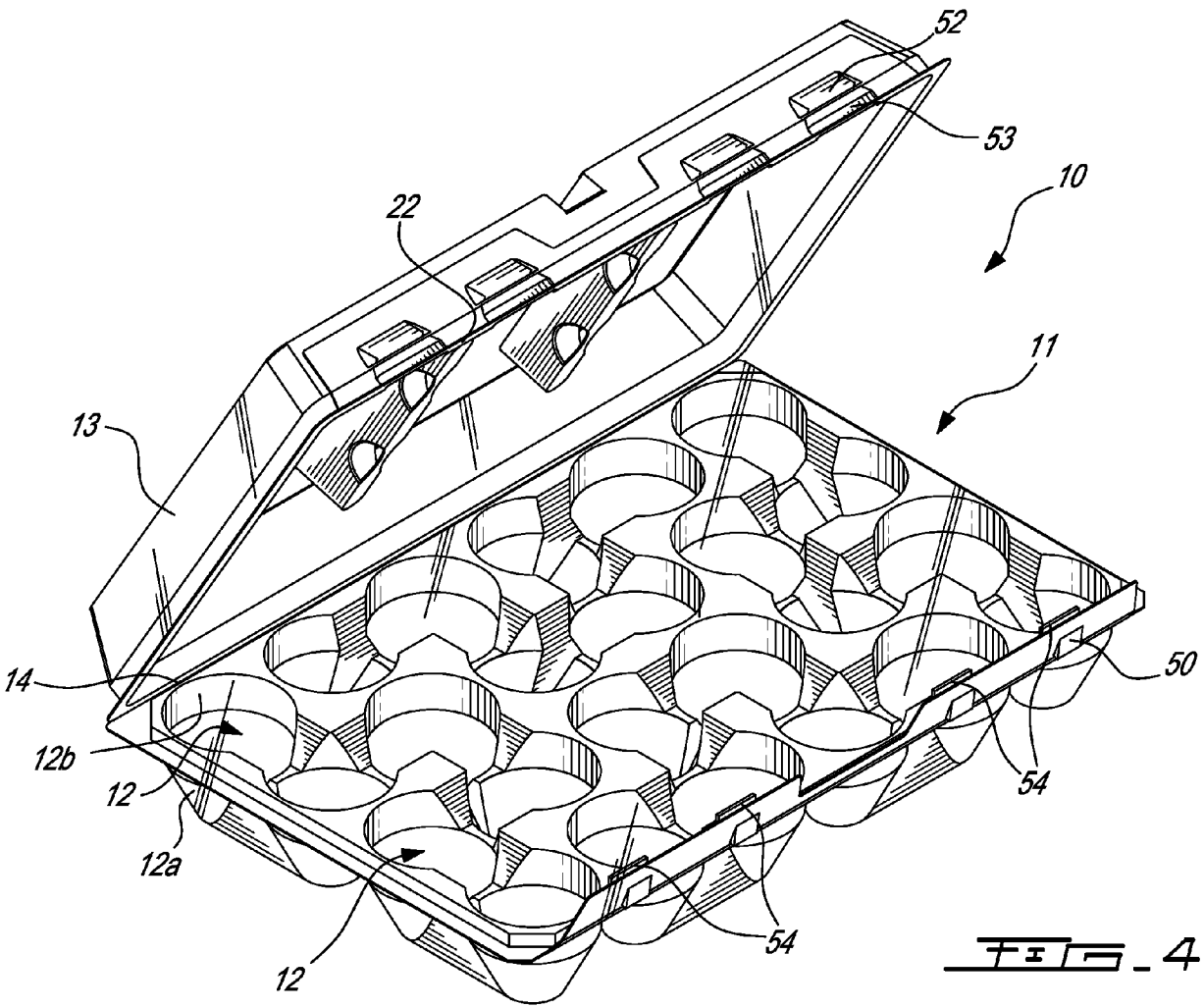
FIG. 4 is a perspective view of a closure system of the egg container of FIGS. 1 and 2.

Referring concurrently to FIGS. 4 and 5, a closure system is illustrated for the egg container 10. The closure system is used with two-fold egg containers. The closure system comprises a tab 50 that projects forwardly from the peripheral flange 20 of the base portion 11. The tab 50 is hinged to the peripheral flange 20, whereby it is shown oriented upwardly in FIGS. 4 and 5. Wedge connectors 51 are formed in the tab 50. FIGS. 4 and 5 show four such wedge connectors 51, but there may be more or fewer of the wedge connectors 51 on the tab 50.

Corresponding female connectors 52 are formed in the top cover portion 13. Each female connector 52 is aligned vertically with a respective wedge connector 51, for mating engagement therewith. The wedge connector 51 is matingly inserted into the female connector 52, and a downwardly-oriented flat surface of the wedge connector 51 abuts against a corresponding abutment surface of the female connector 52, thereby securing the top cover portion 13 to the base portion of the egg container 10. In order to open the egg container 10, the wedge connectors 51 are moved out of engagement with the female connectors 52, for instance by pulling the top cover portion 13 away from the base portion 11. The wedge connectors 51 have a wedge shape to facilitate the engagement of the wedge connectors 51 in the female connectors 52 when closing the egg container 10, by presenting a ramp portion against which the top cover portion 13 slides during closing of the egg container 10.

It is observed that the female connectors 52 may be wider than the wedge connectors 51, as shown in FIGS. 7 and 8. This excess width of the female connectors 52 is to ensure that the wedge connectors 51 fit into the female connectors 52 despite any misalignment of the top cover portion 13 with respect to the base portion 11.

Clearances 53 are defined in the top cover portion 13, and are each paired up with one of the female connectors 52. The clearances 53 are positioned below the female connectors 52 when the egg container 10 is closed. The clearances 53 of a bottom container 10 accommodate the female connectors 52 of a top container 10 when the containers 10 are stacked one on another. This ensures that stacks of open containers 10 are vertically straight.

The clearances 53 form a passage that facilitates the demolding of the egg container. More specifically, the presence of the female connectors 52 requires the presence of corresponding protrusions on the mold used to form the egg container 10. As the female connectors 52 project outwardly from the inner cavity of the top cover portion 13, there have been some difficulties in removing the egg container 10 from its mold without deforming the egg container. Therefore, the use of the clearances 53 is particularly practical when the egg container 10 is stacked open. In an embodiment, a portion of the clearances 53 adjacent to the female connectors is ramp-shaped to facilitate engagement of the connectors 52 and 53. It is pointed out that there may be a single elongated one of the female connectors 52 and a single elongated one of the clearances 53 for a plurality of wedge connectors 51. In another embodiment, as illustrated in FIG. 4, the egg container 10 has the peripheral flange 22 and the clearances 53 open into the peripheral flange 22.

In an embodiment, posts 54 may be provided to project upwardly from the base portion 11, and are placed behind the wedge connectors 51. The posts 54 are positioned so as to be in close proximity to a rear side of the wedge connectors 51 when the egg container 10 is closed. Accordingly, in case of excess pressure on the top cover portion 13, the wedge connectors 51 will not disengage from the female connectors 52, as the posts 54 will prevent the tab from rotating inwardly. Posts or other like abutment members may be used to limit the inward rotation of the tab 50.

The egg containers 10 and 10' may have one or more of the elements described above. Although the egg containers 10 and 10' are preferably made of a transparent thermoplastic that is molded (e.g., vacuum molded), it is considered to provide some of the above-referred embodiments in other materials.

The egg containers of the present disclosure may contain any suitable number of egg receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are of 0.0175 inch in thickness, but other thicknesses as low as 0.012 to as high as 0.022 inch are also contemplated. It is pointed out that the thickness may be outside of these ranges, especially after the container 10 is formed. However, any suitable thickness can be used, depending on the fragility of the objects packaged in the container 10.

The invention claimed is:

1. A container for receiving frangible items comprising:

a sheet of polymer formed into:

a base portion having a plurality of item receiving cavities for supporting frangible items;

at least one cover portion having at least one item covering concavity for covering the frangible items, the cover portion having a generally flat peripheral wall defining the at least one item covering concavity;

a first hinge between a first longitudinal edge of the base portion and the cover portion for rotating the cover portion onto the base portion to hold the frangible items captive in the item receiving cavities;

connectors to block the cover portion to the base portion when closed together;

at least one grasping wall spanning between the two item receiving cavities on an opening side of the container, the two item receiving cavities being along a second longitudinal edge of the base portion, the grasping wall projecting away from the two egg receiving cavities and outward from the container to define a grasping surface; and friction surface means on the grasping surface.

2. The container according to claim 1, further comprising a vertical peripheral wall above the egg receiving cavities in the base portion, the grasping wall merging with the vertical peripheral wall to form concurrently the grasping surface, with the friction surface means being on the grasping wall and on the vertical peripheral wall.

3. The container according to claim 1, comprising solely a single one of the grasping wall between egg receiving cavities.

4. The container according to claim 1, wherein the friction surface means are ribs molded with the base portion.

5. The container according to claim 1, further comprising friction surface means on the generally flat peripheral wall of the cover portion, the friction surface means being in vertical alignment with the friction surface means of the base portion.

6. The container according to claim 1, wherein the grasping wall spans between the item receiving cavities on opposite sides of a longitudinal center of the container.

7. The container according to claim 1, further comprising:

two of the cover portion, with an intermediate one of the cover portions item covering cavities for covering the frangible items on the item receiving cavities;

a second hinge between the second longitudinal edge of the base portion, and the intermediate cover portion for rotating the intermediate cover portion onto the base portion, with a top one of the cover portions being hinged about the first longitudinal edge to hold the base portion, the intermediate cover portion and the top cover portion closed together.

8. The container according to claim 1, further comprising a rib at a bottom of the grasping wall to reinforce the grasping wall, the rib extending between the two item receiving cavities.

9. The container according to claim 1, wherein the frangible items are eggs, and each of the egg receiving cavities receives one egg.

10. A container for receiving frangible items comprising:

a sheet of polymer molded into:

a base portion having a plurality of item receiving cavities for supporting frangible items;

a cover portion having at least one item covering concavity for covering the frangible items, the cover portion having a generally flat peripheral wall defining the at least one item covering concavity;

a first hinge between a first longitudinal edge of the base portion and the cover portion for rotating the cover portion onto the base portion in closing the container to hold the frangible items captive in the item receiving cavities;

an elongated tab having wedge-shaped male connectors oriented with a ramp portion facing upward;

a second hinge between a second longitudinal edge of the base portion and the elongated tab for rotating the elongated tab toward an interior of the base portion;

at least one female connector projecting outwardly from the generally flat peripheral wall of the cover portion, the at least one female connector being in vertical alignment with the wedge-shaped male connectors of the tab for mating engagement therewith when the container is closed; and at least one outwardly projecting clearance positioned between the at least one female connector and the second longitudinal edge of the base portion when the container is closed.

11. The container according to claim 10, comprising one of the female connector and one of the outwardly projecting clearance for each one of the wedge-shaped male connector.

12. The container according to claim 10, wherein the at least one of outwardly projecting clearance has a ramp portion adjacent to the at least one female connector, the ramp portion being oriented upward.

13. The container according to claim 10, comprising one of the female connector for each one of the wedge-shaped male connector, the female connector being substantially wider than the wedge-shaped male connector.

14. The container according to claim 10, further comprising a peripheral flange defining a periphery of the cover portion, the clearances opening into the peripheral flange.

15. The container according to claim 10, further comprising at least one abutment member projecting upwardly from the base portion and positioned adjacent to the tab to limit an inward movement of the tab when the container is closed.

16. The container according to claim 10, wherein the frangible items are eggs, and each of the egg receiving cavities receives one egg.

* * * * *

UNITED STATES PATENT AND TRADEMARK OFFICE

CERTIFICATE OF CORRECTION

PATENT NO. : 7,775,364 B1
APPLICATION NO. : 12/628242
DATED : August 17, 2010
INVENTOR(S) : Germain Archambault and François Blanchette It is certified that error appears in the above-identified patent and that said Letters Patent is hereby corrected as shown below:

IN THE CLAIMS:

At column 5, line 20:
"connectors to block the cover portion to the base portion" should read
-- connectors to lock the cover portion to the base portion --

At column 5, line 26:
"wall projecting away from the two egg receiving cavi-" should read
-- wall projecting away from the two item receiving cavi- --

At column 5, line 49:
"two of the cover portion, with an intermediate one of the" should read
-- two of the cover portions, with an intermediate one of the --

At column 5, line 50:
"cover portions item covering cavities for covering the" should read
-- cover portions having item covering cavities for covering the --

At column 6, line 6:
"gible items are eggs, and each of the egg receiving cavities" should read
-- gible items are eggs, and each of the item receiving cavities --

At column 6, line 40:
"least one of outwardly projecting clearance has a ramp por-" should read
-- least one outwardly projecting clearance has a ramp por- --

Signed and Sealed this
Twenty-first Day of April, 2015

Michelle K. Lee

Michelle K. Lee
*Director of the United States Patent and Trademark Office*